US008803638B2

(12) United States Patent
Kildal

(10) Patent No.: US 8,803,638 B2
(45) Date of Patent: Aug. 12, 2014

(54) WAVEGUIDES AND TRANSMISSION LINES IN GAPS BETWEEN PARALLEL CONDUCTING SURFACES

(75) Inventor: Per-Simon Kildal, Pixbo (SE)

(73) Assignee: Kildal Antenna Consulting AB, Pixbo (SE)

( * ) Notice: Subject to any disclaimer, the term of this patent is extended or adjusted under 35 U.S.C. 154(b) by 659 days.

(21) Appl. No.: 13/002,950

(22) PCT Filed: Jun. 22, 2009

(86) PCT No.: PCT/EP2009/057743

§ 371 (c)(1),
(2), (4) Date: Apr. 1, 2011

(87) PCT Pub. No.: WO2010/003808

PCT Pub. Date: Jan. 14, 2010

(65) Prior Publication Data

US 2011/0181373 A1 Jul. 28, 2011

(30) Foreign Application Priority Data

Jul. 7, 2008 (EP) ..... 08159791

(51) Int. Cl.

| | |
|---|---|
| ***H01P 1/00*** | (2006.01) |
| ***H01P 3/00*** | (2006.01) |
| ***H01P 3/08*** | (2006.01) |
| ***H01P 1/20*** | (2006.01) |
| ***H01P 3/123*** | (2006.01) |

(52) U.S. Cl.

CPC ..... *H01P 3/087* (2013.01); *H01P 1/2005* (2013.01); *H01P 3/123* (2013.01)

USPC ..... 333/248; 333/239; 333/185

(58) Field of Classification Search

USPC ..... 333/239, 248, 243, 244, 185

See application file for complete search history.

(56) References Cited

U.S. PATENT DOCUMENTS 5,065,123 A * 11/1991 Heckaman et al. ..... 333/246
5,923,225 A 7/1999 De Los Santos (Continued)

FOREIGN PATENT DOCUMENTS

EP 1 227 536 A1 7/2002
EP 1 331 688 A1 7/2003

(Continued)

OTHER PUBLICATIONS

Per-Simon Kildal; "Artificially Soft and Hard Surfaces in Electromagnetics", IEEE Transactions on Antennas and Propagation, vol. 38, No. 10, Oct. 1990, pp. 1537-1544.

(Continued)

*Primary Examiner* — Robert Pascal
*Assistant Examiner* — Kimberly Glenn
(74) *Attorney, Agent, or Firm* — Ladas & Parry LLP

(57) ABSTRACT

A microwave device having a narrow gap between two parallel surfaces of conducting material by using a texture or multilayer structure on one of the surfaces. The fields are mainly present inside the gap, and not in the texture or layer structure itself, so the losses are small. The microwave device further comprises one or more conducting elements, such as a metal ridge or a groove in one of the two surfaces, or a metal strip located in a multilayer structure between the two surfaces. The waves propagate along the conducting elements. At least one of the surfaces is provided with means to prohibit the waves from propagating in other directions between them than along the ridge, groove or strip. At very high frequency the gap waveguides and gap lines may be realized inside an IC package or inside the chip itself.

67 Claims, 5 Drawing Sheets

(56) References Cited

U.S. PATENT DOCUMENTS

| | | | | |
|---|---|---|---|---|
| 6,072,375 | A * | 6/2000 | Adkins et al. | 333/1 |
| 6,414,573 | B1 | 7/2002 | Swineford et al. | |
| 6,535,083 | B1 * | 3/2003 | Hageman et al. | 333/210 |
| 6,622,370 | B1 | 9/2003 | Sherman et al. | |
| 6,859,114 | B2 | 2/2005 | Eleftheriades et al. | |
| 7,439,822 | B2 * | 10/2008 | Shimura et al. | 333/26 |
| 7,495,532 | B2 * | 2/2009 | McKinzie, III | 333/219 |
| 7,626,476 | B2 * | 12/2009 | Kim et al. | 333/238 |
| 7,659,799 | B2 * | 2/2010 | Jun et al. | 333/212 |
| 2005/0040918 | A1 | 2/2005 | Kildal | |
| 2011/0181377 | A1 * | 7/2011 | Vanhille et al. | 333/245 |

FOREIGN PATENT DOCUMENTS

| | | | |
|---|---|---|---|
| JP | 2000-022406 | A | 1/2000 |
| JP | 2001-284870 | A | 10/2001 |
| JP | 2002-217613 | A | 8/2002 |

OTHER PUBLICATIONS

Debasis Dawn, et al; "A Novel Electromagnetic Bandgap Metal Plate for Parallel Plate Mode Suppression in Shielded Structures", IEEE Microwave and Wireless Components Letters, IEEE Service Center, New York, NY, US, vol. 12, No. 5, May 1, 2002; XP011066851; ISSN: 1531-1309; the whole document.

Per-Simon Kildal; "Artifically Soft and Hard Surfaces in Electromagnetics", IEEE Transactions on Antennas and Propagation, IEEE Service Center, Piscataway, NJ, US, vol. 38, No. 10, Oct. 1, 1990, pp. 1537-1544, XP002292191, ISSN: 0018-926X the whole document.

T.H. Loh, et al; "Photonic bandgap surfaces with interdigitated corrugations", Electronics Letter, IEE Stevenage, GB , vol. 40, No. 18, Sep. 2, 2004, pp. 1123-1125, XP006022541, ISSn: 0018-926X the whole document.

International Search Report: PCT/EP2009/057743.

J.M. Schellenberg, "CAD Models for Suspended and Inverted Microstrip", IEEE Transactions on Microwave Theory and Techniques, vol. 43, No. 6, Jun. 1995, pp. 1247-1252; Date of current version: Aug. 6, 2002.

Z. Sipus, et al; "Green's functions for planar soft and hard surfaces derived by asymptotic boundry conditions", IEE Proc-Microw. Antennas Propag., vol. 144, No. 5, Oct. 1997, pp. 321-328.

Dan Sievenpiper, et al; "High-Impedance Electromagnetic Surfaces with a Forbidden Frequency Band", IEEE Transactions on Microwave Theory and Techniques, vol. 47, No. 11, Nov. 1999, pp. 2059-2074.

Sergei P. Skobelev, et al; "Mode-Matching Modeling of a Hard Conical Quasi-TEM Horn Realized by an EBG Structure With Strips and VIAS", IEEE Transactions on Antennas and Propagation, vol. 53, No. 1, Jan. 2005, pp. 139-143.

Tore N. Anderson; "Rectangular and Ridge Waveguide", IRE Transactions on Microwave Theory and Techniques, Jul. 17, 1956, pp. 201-209.

Jiro Hirokawa, et al.; "Single-Layer Feed Waveguide Consisting of Posts for Plane TEM Wave Excitation in Parallel Plates", IEEE Transactions on Antennas and Propagation, vol. 46, No. 5, May 1998, pp. 625-630.

Per-Simon Kildal, et al; "EM Modeling of Surfaces with Stop or Go Characteristics—Artificial Magnetic Conductors and Soft and Hard Surfaces", Applied Computational Electromagnetcis Society Journal, vol. 18, No. 1, pp. 32-40, Mar. 2003.

Japanese Office Action dated Sep. 4, 2013; Appln No. 2011-517071.

* cited by examiner

WAVEGUIDES AND TRANSMISSION LINES IN GAPS BETWEEN PARALLEL CONDUCTING SURFACES

FIELD OF THE INVENTION

The present invention represents a new way of realizing electromagnetic transmission lines, waveguides and circuits that is advantageous when the frequency is so high that existing technologies such as coaxial lines, cylindrical waveguides, and microstrip lines and other substrate-bound transmission lines, do not work well due to ohmic losses and manufacturing problems. The invention relates mainly to frequencies above 30 GHz, i.e. the millimeter wave region, and even above 300 GHz, i.e. submillimeter waves, but the invention may also be advantageous at lower frequencies than 30 GHz.

BACKGROUND

Electronic circuits are today used in almost all products, and in particular in products related to transfer of information. Such transfer of information can be done along wires and cables at low frequencies (e.g. wire-bound telephony), or wireless through air at higher frequencies using radio waves both for reception of e.g. broadcasted audio and TV, and for two-way communication such as in mobile telephony. In the latter high frequency cases both high and low frequency transmission lines and circuits are used to realize the needed hardware. The high frequency components are used to transmit and receive the radio waves, whereas the low frequency circuits are used for modulating the sound or video information on the radio waves, and for the corresponding demodulation. Thus, both low and high frequency circuits are needed. The present invention relates to a new technology for realizing high frequency components such as transmitter circuits, receiver circuits, filters, matching networks, power dividers and combiners, couplers, antennas and so on.

The first radio transmissions took place at rather low frequency below 100 MHz, whereas nowadays the radio spectrum (also called electromagnetic spectrum) is used commercially up to 40 GHz, and some systems for higher frequencies are planned and even to some degree in use already. The reason for the interest in exploring higher frequencies is the large bandwidths available. When wireless communication is spread to more and more users and made available for more and more services, new frequency bands must be allocated to give room for all the traffic. The main requirement is for data communication, i.e. transfer of large amounts of data in as short time as possible.

There exist already transmission lines for light waves in the form of optical fibers that can be buried down and represents an alternative to radio waves when large bandwidth is needed. However, such optical fibers also require electronic circuits connected at either end. There may even be needed electronic circuits for bandwidths above 40 GHz to enable use of the enormous available bandwidths of the optical transmission lines. The present invention can be used to realize electronic circuits above typically 40 GHz where there exist no good alternatives solution today for low loss and mass production.

Electronic circuits below typically 300 MHz (i.e. wavelengths longer than 1 meter) are easily realized in printed circuit boards (PCB) and in integrated circuits using designs based on concentrated circuit elements such as resistors, inductors, capacitors and transistor amplifiers. Such technology may also work at higher frequency, but the performance degrades gradually when the size of the PCB and integrated circuit package become comparable to a wavelength. When this happens, it is better to realize the circuits by connecting together in various ways pieces of transmission lines or waveguides. This is normally referred to as microwave technology and is commonly in use between 300 MHz and 30 GHz, i.e. the microwave region. The most common transmission lines are coaxial cables and lines, microstrip lines, and cylindrical waveguides. There are problems with these technologies for higher frequencies than 30 GHz because of increasing losses and manufacturing problems (smaller dimensions and stricter tolerance requirements). The tolerance requirements could be some pro mille (1/1000) of a wavelength, which becomes very small when recalling that the wavelength is 10 mm at 30 GHz. Also, the coaxial lines and waveguides need to be thinner than typically 0.5 wavelengths to work with a required single mode. Such hollow lines and guides are very difficult to manufacture, which makes it necessary at high frequency to instead use microstrip lines and other substrate-bound transmission lines. However, substrate-bound transmission lines have larger losses that increase with increasing frequency, so the performance degrades. The output power of transistors is lower at such high frequencies, and when they are mounted into lossy transmission lines the power generation becomes even a larger problem. The present invention relates to electronic circuits made by using a new transmission line that at high frequencies is advantageous with respect to losses and manufacturability.

There exist already some waveguides particularly intended for use at high frequencies because they have lower losses and are cheaper to manufacture than traditional air-filled cylindrical waveguides and because they have lower losses than microstrip lines. Such a waveguide is the so-called Substrate Integrated Waveguide (SIW), as described in J. Hirokawa and M. Ando, "Single-layer feed waveguide consisting of posts for plane TEM wave excitation in parallel plates," IEEE Trans. Antennas Propag., vol. 46, no. 5, pp. 625-630, May 1998. Here, the waveguide is made in the substrate of a PCB by using metalized via holes as walls. These waveguides still suffer from losses due to the substrate, and the metalized via holes represent a complication that is expensive to manufacture. The present invention does not necessarily make use of via holes and substrate to provide a high frequency waveguide, but it can make use of such if needed of other reasons.

The last 8-10 years researchers all over the world have tried to synthesize artificial electromagnetic materials that have abnormal characteristics. Such materials are often referred to as metamaterials, and one of the most desirable abnormal characteristics to achieve in electronics is the equivalent of magnetic conductivity, which does not exist in nature. The first conceptual attempt to realize magnetic conductivity described in the scientific literature was the so-called soft and hard surfaces, see P-S. Kildal, "Artificially soft and hard surfaces in electromagnetics", IEEE Trans. Antennas Propagat., Vol. 38, No. 10, pp. 1537-1544, October 1990. The ideal soft and hard surfaces are nowadays most conveniently described as PEC/PMC strip grids, i.e. grids of parallel strips, where every second strip is perfectly electric conducting (PEC) and perfectly magnetic conducting (PMC), respectively, see P.-S. Kildal and A. Kishk, "EM Modelling of surfaces with STOP or GO characteristics—artificial magnetic conductors and soft and hard surfaces", Applied Computational Electromagnetics Society Journal, Vol. 18, No. 1, pp. 32-40, March 2003. The PMC strips are realized by metal grooves with effectively quarter wavelengths depth, or by equivalent means such as metal strips on a grounded substrate with metallised via holes between the strips and the via holes. The characteristics of the PEC/PMC strip grids are that the anisotropic boundary conditions allow waves of arbitrary polarization to propagate along the strips (hard surface case), whereas they stop wave propagation in other directions along the surface and in particular orthogonally to the strips (soft surface case). Such PEC/PMC strip grids can be used to realize new antenna types, see P.-S. Kildal, "Strip-loaded dielectric substrates for improvements of antennas", U.S. patent application Ser. No. 10/495,330—Filed Nov. 12, 2002. The present invention makes use of the soft and hard surfaces and PEC/PMC strip grids to realize a high frequency waveguide that was not foreseen in U.S. patent application Ser. No. 10/495,330.

The so-called electromagnetic bandgap (EBG) surface stops wave propagation in a similar way as the soft surface, but for all directions of propagation. This appeared for the first time in the scientific literature in the following paper by D. Sievenpiper, L. J. Zhang, R. F. J Broas, N. G. Alexopolous, and E. Yablonovitch, "High-impedance electromagnetic surfaces with a forbidden frequency band", IEEE Transactions on Microwave Theory and Techniques, Vol. 47, No. 11, pp. 2059-2074, November 1999. Both Kildal's soft surface and Sievenpiper's EBG surface stop wave propagation along the surfaces, and they contain the PMC as an important surface component. Sievenpiper's invention has resulted in a number of patents, but the present invention is not described in them.

The propagation characteristics along soft and hard surfaces are quite well known, both when they are used in waveguides and as open surfaces, see e.g. S. P. Skobelev and P.-S. Kildal, "Mode-matching modeling of a hard conical quasi-TEM horn realized by an EBG structure with strips and vias", IEEE Transactions on Antennas and Propagation, vol. 53, no. 1, pp. 139-143, January 2005, and Z. Sipus, H. Merkel and P-S. Kildal, "Green's functions for planar soft and hard surfaces derived by asymptotic boundary conditions", IEE Proceedings Part H, Vol. 144, No. 5, pp. 321-328, October, 1997. However, the studies have been limited to cylindrical waveguides and open surfaces, respectively. The present invention creates instead local transmission lines, waveguides and circuit components between parallel conductors and makes use of special techniques to prevent spreading of the waves between the conductors and to suppress undesired higher order modes.

There has been other attempts to make high frequency metamaterial waveguides, such as in George V. Eleftheriades, Keith G. Balmain, "Metamaterials for controlling and guiding electromagnetic radiation", U.S. Pat. No. 6,859,114—Filed Jun. 2, 2003. However, this and other related solutions make use of wave propagation inside the metamaterial, or at the surface of it, both of which cause losses and large dispersion. Dispersion means that the bandwidth becomes narrow. The present invention controls wave propagation between parallel conducting plates, and it has lower losses and potentially a much larger bandwidth than U.S. Pat. No. 6,859,114.

SUMMARY OF THE INVENTION

The purpose of the present invention is to remove or at least strongly reduce problems related to ohmic losses and manufacturability when designing microwave devices such as, but not limited to, transmission lines, waveguides and transmission line and waveguide circuits at frequencies above typically 30 GHz, but the invention can also be advantageous for use at lower frequencies.

In the context of the present application, the term "microwave device" is used to denominate any type of device and structure capable of transmitting, transferring, guiding and controlling the propagation of electromagnetic waves, particularly at high frequencies where the dimensions of the device or its mechanical details are of the same order of magnitude as the wavelength, such as waveguides, transmission lines, waveguide circuits or transmission line circuits. In the following, the present invention will be discussed in relation to various embodiments, such as waveguides, transmission lines, waveguide circuits or transmission line circuits. However, it is to be appreciated by someone skilled in the art that specific advantageous features and advantages discussed in relation to any of these embodiments are also applicable to the other embodiments.

The present invention provides a new way of realizing electromagnetic transmission lines, waveguides and circuits of them is disclosed, that is advantageous when the frequency is so high that existing transmission lines and waveguides have too large losses or cannot be manufactured cost-effectively with the tolerances required. Thus, the new technology is intended to replace coaxial lines, hollow cylindrical waveguides, and microstrip lines and other substrate-bound transmission lines at high frequencies. The new transmission lines and waveguides and their circuits are realized in a narrow gap between two parallel surfaces of conducting material, by using a texture or multilayer structure on one of the surfaces. The fields are mainly present inside the gap, and not in the texture or layer structure itself, so the losses are small. The waveguide is defined by one of the surfaces and either a metal ridge (ridge gap waveguide) or a groove (groove gap waveguide) in the other surface, and the transmission line is defined by one of the surfaces and a metal strip located inside the gap between the two surfaces (microstrip gap line). The waves propagate along the ridge, groove and strip, respectively. No metal connections between the two metal surfaces are needed. At least one of the surfaces is provided with means to prohibit the waves from propagating in other directions between them than along the ridge, groove or strip, e.g. by using a texture or structure in the metal surface itself or a periodic metal layer in the multilayer structure. The texture or structure will often be periodic or quasi-periodic and designed to interact with the waves in such a way that they work macroscopically as artificial magnetic conductors (AMC), electromagnetic bandgap (EBG) surfaces or soft surface. There may be a solid metal wall along the rim of at least one of the two metal surfaces. This wall can be used to keep the surfaces in stable position relative to each other with a well defined and small gap between them. This wall can be located quite close to the circuits without affecting the performance, and it will even provide a good packaging solution for integration of active integrated circuits. At very high frequency the gap waveguides and gap lines may be realized inside an IC package or inside the chip itself.

The basic geometry of the present invention comprises two parallel conducting surfaces. These surfaces can be the surfaces of two metal bulks, but they can also be made of other types of materials having a metalized surface. They can also be made of other materials with good electric conductivity. The two surfaces can be plane or curved, but they are in both cases separated by a very small distance, a gap, and the transmission line circuits and waveguide circuits are formed inside this gap between the two surfaces. The gap is typically filled with air, but it can also be fully or partly dielectric-filled, and its size is typically smaller than 0.25 wavelengths, effectively. We will refer to the gap size as its height envisioning one surface above the other at a certain gap height.

One of (or at least one of) the surfaces is provided with a texture or a thin multilayer structure that is used to realize e.g.

a PMC surface, an EBG surface, or a PEC/PMC strip grid. With multilayer structure we mean at least two layers, such as a metal ground plane and a dielectric substrate. By this texture or multilayer structure it is possible to control the wave propagation in the gap between the two surfaces so that it follows specific paths, appearing as transmission lines or waveguides inside the gap, thus gap transmission lines and gap waveguides. By connecting together gap waveguides (or transmission lines) of different lengths, directions and characteristic impedances, and by controlling the coupling between parallel gap waveguides (or transmission lines), it is possible to realize waveguide (or transmission line) components and complete waveguide (or transmission line) circuits between the two parallel conducting surfaces, in a similar manner to how such circuits are realized with conventional microstrip lines and cylindrical waveguides.

The transmission line or waveguide according to the invention can have three principally different forms:

a) The ridge gap waveguide.
b) The microstrip gap line.
c) The groove gap waveguide.

A simplified canonical geometry of gap waveguide or gap line is a PEC surface parallel with a PMC surface at a certain gap height, wherein a) for the ridge case there are traces or lines of PEC in the otherwise perfectly magnetic conducting PMC surface, and
b) for the microstrip case there are lines of PEC inside the gap between the two surfaces, and
c) for the groove case there are grooves in the PEC surface.

The PEC ridges and lines in the first two cases make them both similar to a normal microstrip line where the air region is replaced by a PMC surface (microstrip gap line case), or at least the parts of the air region interfacing directly to the substrate (ridge case) and where the substrate fills the gap, which in the microstrip gap line normally would be airfilled. Thus, the PMC surface plays the role of the air interface in both the ridge gap waveguide and the microstrip gap line. Thereby, many of the transmission line equations that apply to microstrip lines also apply as a good approximation to both the ridge gap waveguide and the microstrip gap line. The characteristic impedance of the gap waveguide and line is therefore given approximately by $$Z_k = Z_0 {}^{h}/_{s}{}^{w}$$

where $Z_0$ is the wave impedance in air (or in the dielectric filling the gap region), w is the width and h is the distance of the PEC traces or lines from the PEC surface. This simplified theory works over the bandwidth in which the realization of the PMC surface works as a PMC. A metal conductor is in most cases a good approximation to a PEC over a wide frequency band.

The ridge gap waveguide and the microstrip gap line have more in common with the so-called suspended or inverted microstrip line, in which the microstrip lines are suspended at distance h from a ground plane on one side by using a dielectric substrate on the opposite side of the microstrip line. The substrate is fixed by surrounding spacers in such a way that there is an air gap between the metal strips and the metal ground plane, see e.g. J. M. Schellenberg, "CAD models for suspended and inverted microstrip", IEEE Trans. Microwave Theory and Techniques, Vol. 43, No. 6, pp. 1247-1252, June 1995. In the inverted microstrip line the waves propagate in the air gap between a conducting strip and a ground plane, in the same way as in the gap microstrip line. The difference is that the microstrip gap line has another ground plane on the opposite side of the conducting strip, and this additional ground plane is provided with a texture or a multilayer structure that prohibits undesired modes to propagate between the two ground planes and between the conducting line and the extra textured or layered ground plane. Such waves would otherwise make it impossible to realize the high frequency circuit due to the undesired modes that would create resonances and other problems.

The ridge gap waveguide has also similarities with the normal ridge waveguide, which is described e.g. by T. N. Anderson, "Rectangular and Ridge Waveguide", IEEE Trans. Microwave Theory and Techniques, Vol. 4, No. 4, pp. 201-109, October 1956. The difference is that the metal sidewalls are removed in the gap waveguide, and the fields are prohibited from leaking through the opening because the basic mode propagating between parallel PMC and PEC surfaces is under cut-off and thus doesn't propagate when the height of the gap between the two surfaces is smaller than 0.25 wavelengths.

The basic theory of the gap waveguide is very simple. If the opposing surfaces were smooth conductors, TEM waves with the E-field orthogonal to the surfaces could propagate between them for any size of the gap. These waves could propagate in all directions if the surfaces were wide, and they would be reflected from the rim of the surfaces, which may be open or closed with walls, and bounce back and forth within the gap, creating a lot of uncontrolled resonances. When the rim is open there would also be a significant loss of power due to undesired radiation. Such resonances make smooth parallel conductors impossible to use in practice as transmission lines at high frequencies. The purpose of the invention is to provide at least one of the surfaces with a texture or multilayer structure, both of which should preferably be designed in such a way that waves are guided as single modes within the gap, in controlled and desired directions.

The invention is based on the following theoretical facts that can be derived from Maxwell's equations:

a) No waves can propagate in any direction in the gap between a PEC and a PMC if the gap height is smaller than 0.25 wavelengths.
b) No waves can propagate in any direction between a PEC and an EBG surface if the gap height is smaller than a specific height which depends on the geometry of the bandgap surface. This height is normally smaller than 0.25 wavelengths as well.
c) Waves in the gap between a PEC/PMC strip grid surface and a PEC can only follow the direction of the PEC strips. Waves in other directions are strongly attenuated when the height is smaller than 0.25 wavelengths.

There are also other types of surfaces according to the invention that can stop wave propagation between the surfaces, and we refer to them behind also under the general term "wave stop surfaces".

Using the above theoretical facts we can design gap waveguides and gap lines, and then we can put the waveguides and lines together to circuits and components by making use of similar approaches and practices that are commonly applied when designing circuits and components of cylindrical waveguides and microstrip lines at lower frequencies.

The third type of gap waveguide/line is the groove gap waveguide. This is formed between the texture or layered structure on one of the conducting surface and a groove in the opposing conducting surface. It resembles a standard rectangular metal waveguide except that one wall is replaced by an air gap and a texture or multilayer structure. There is no metal contact between the walls of the groove and the opposing surface, and the field is prohibited from leaking out through the slot into the gap region between the two surfaces by the texture or multilayer structure in the same way as described previously for the ridge gap waveguide and the microstrip gap line. The opposing top surface may either contain a texture in the region where it acts as a waveguide wall, or be a PEC there. The texture or multilayer structure may alternatively be provided in the same surface where the groove is, and the groove may alternatively extend into both the two surfaces, and not only one of them.

It is an important fact that the two opposing surfaces according to the invention can have metal connection to each other at some distance from the gap circuits without affecting their performance. This is a mechanical advantage, as one of the surfaces can be made with a solid metal wall around it that provides support for the other surface in such a way that the gap height is well defined everywhere. Thereby, the whole gap waveguide/line circuit may be completely encapsulated by metal, providing strong shielding to the exterior circuits and environment.

The texture or multilayer structure on at least one of the surfaces according to the invention is used to realize cut-off conditions for waves propagating in undesired directions between the two surfaces. This texture can be used to realize as close as possible PMC, PEC/PMC strip grids, or electromagnetic bandgap (EBG) surfaces. The PMC can provide cut-off condition together with a parallel conductor if the gap height is smaller than 0.25 wavelengths, the EBG surface PEC/PMC surface can create cut-off for heights up to 0.5 wavelengths in some cases, but the condition is polarization dependent (and direction dependent for the PEC/PMC strip case). The scientific literature describes many ways of realizing surfaces of these types, under the names mentioned above, but also under other names. Examples of such names are corrugated surfaces, high impedance surfaces, artificial magnetic conductors (AMC), electromagnetic crystal surfaces, and photonic bandgap surfaces. This previous literature does however not describe the use of such surfaces to generate the gap waveguides and gap lines of the present invention. Therefore, all such previously known embodiments are new when used together with an opposing surface to control wave propagation between the two surfaces.

The realizations of the invention that are expected to be most simple and useful in the millimeter and submillimeter wave region are metal post surfaces and corrugated surfaces. The metal posts look like a bed of nails, and operates close to a PMC at one frequency. The metal posts and corrugations can easily be manufactured in a metal surface by milling or etching.

Another important realization according to the invention is a multilayer structure, such as:

A. many circuit boards located on top of each other,
B. different thin material layers deposited on top of each other,
C. different layers doped into a substrate, and
D. even other methods consistent with how active and passive electronic components are already manufactured.

The metal surfaces as well as the wave stop surface according to the invention can then be realized as specific layers at such multilayer structure.

The provided texture and multilayer structure will strongly reduce possible resonance in the cavity formed between the two surfaces, which otherwise is a major problem when encapsulating e.g. microstrip circuits. The reason for this is that the texture or multilayer structure prohibit undesired wave propagation and thereby undesired cavity modes. This is only true within the frequency band of operation of the gap waveguide circuits, but it may be extended to other frequency bands by designing the texture and multilayer structure to stop waves even at selected other frequencies where resonances can be expected to provide a problem.

It is clear from the above that the gap waveguide circuits and gap line circuits according to the invention can be located inside a metal enclosure, wherein either the bottom or the top wall or both contain the texture or multilayer structure that are used to realize the gap circuits. This metal enclosure or the multilayer structure itself can easily be designed to include also chips with active integrated circuits (ICs), e.g. for generation of power (i.e. power amplifiers) or for low noise reception (i.e. low noise amplifiers also called LNAs). There are many possible ways of creating a connection between the active integrated components and the gap guide/line circuits:

I. The ICs or even the unpackaged chips may be mounted to the exterior side of the gap waveguide. Then, the leads of the IC may e.g. fit to a socket with legs that penetrate through holes in the metal layer, acting as probes into the underlying gap waveguide and thereby providing a connection between the exterior circuits and the gap waveguide circuits. This is most easily done on the exterior side of the smooth conducting layer of the gap waveguide.
II. The ICs or even the unpacked chips can also be fixed to the interior side of the gap waveguide. This may in particular be convenient if the textured surface is a multilayer structure.
III. The multilayer structure itself may also contain a metal layer separating the interior and exterior regions of the gap waveguide circuits, in which case the IC can be bonded to or in other ways integrated with the multilayer structure either inside or outside the metal layer and thereby inside or outside the gap.
IV. The IC package itself can also be a multilayer structure, which makes it possible at very high frequencies to implement the gap waveguide circuits in the IC package itself.
V. The chip is also a kind of multilayer structure, or it can be made so. Therefore at sub millimeter wave frequencies it will be possible even to implement gap waveguide circuits into the chip itself.

DRAWINGS

Figure 10A:
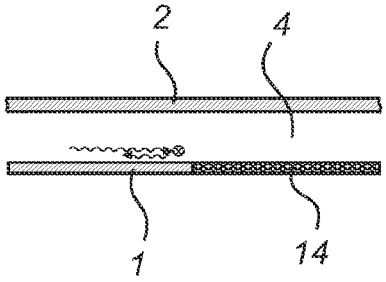
Figure 10B:
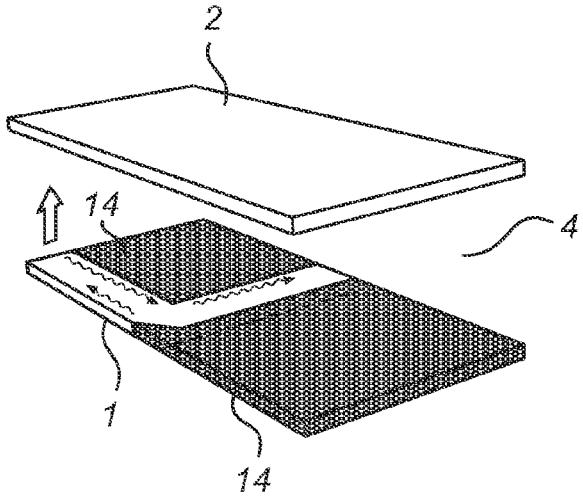
Figure 11A:
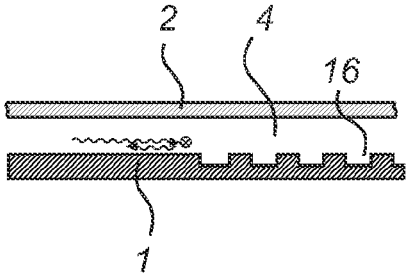
Figure 11B:
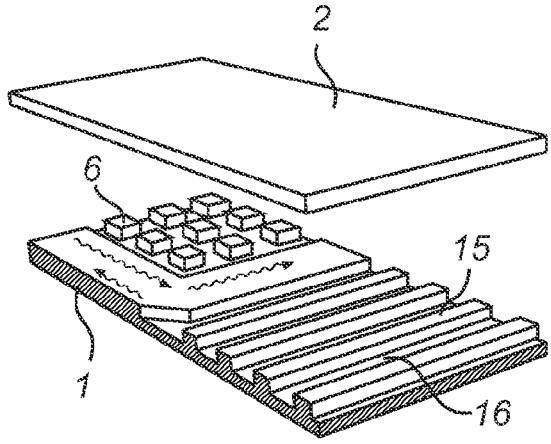

FIGS. 10 and 11 show a cut along the input line of a 90 deg bend in a ridge gap waveguide according to the invention, both in a perspective view (10*a* and 11*a*), and in a cross sectional view (10*b* and 11*b*).

Figure 14:
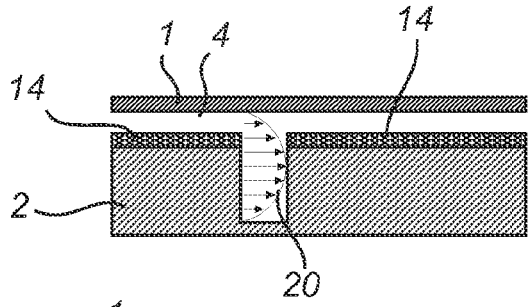
Figure 15:
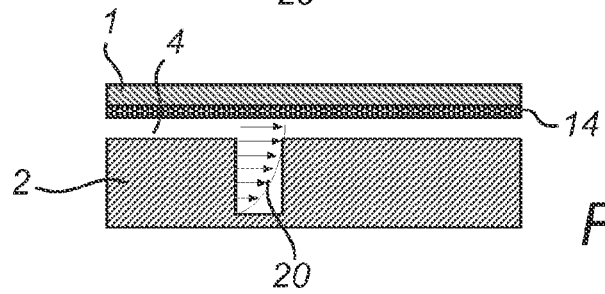
Figure 16:
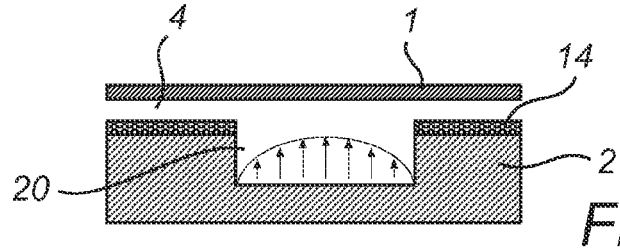

FIGS. 14, 15 and 16 show the cross sections of three examples of groove gap waveguides according to the invention.

DETAILED DESCRIPTION OF THE FIGURES

Figure 1:
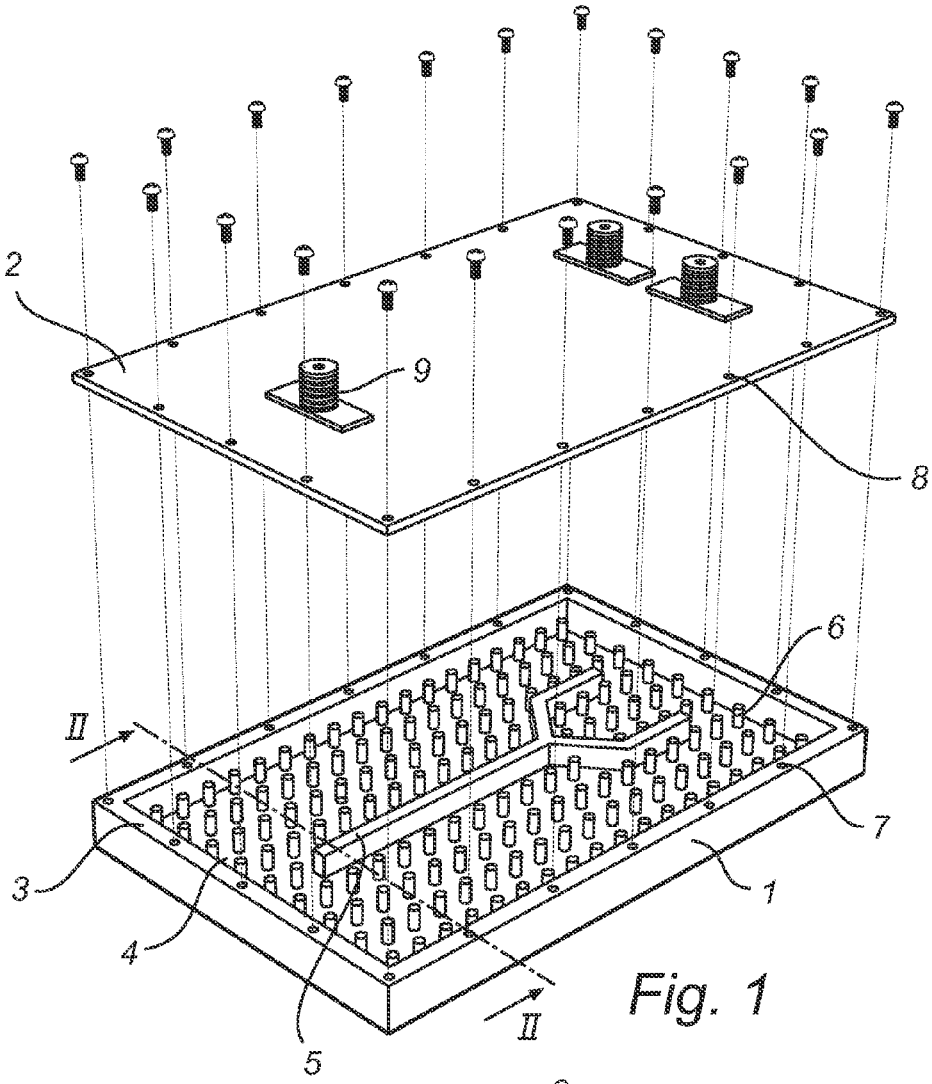
FIG. 1 shows a sketch of an example of a component which is realized by using ridge gap waveguides between metal surfaces, according to the invention. The upper metal surface is shown in a lifted position to reveal the texture on the lower surface.

FIG. 1 shows a two-way power divider or combiner as an example of a component that is an embodiment of the invention. There are two metal pieces providing the upper 1 and lower 2 conducting surfaces. The upper surface is smooth, but the lower surface is machined so that a texture appears. The texture shows a surrounding rim 3 to which the upper surface can be mounted, and a region which is lower than the rim and thereby provides a gap 4 between the upper and lower surfaces when the upper surface is mounted. The metal ridge 5 is forming a two armed fork, and around the ridge there are metal posts 6 providing cut-off conditions for all waves propagating between the lower and upper surfaces except the desired waves along the ridge 5. The posts work similar to a PMC within the operating frequency band. There are screw holes 8 in the upper metal piece that is used to fix it to the metal rim 3 of the lower metal piece, and there are matching screw holes 7 in this rim.

Figure 2:
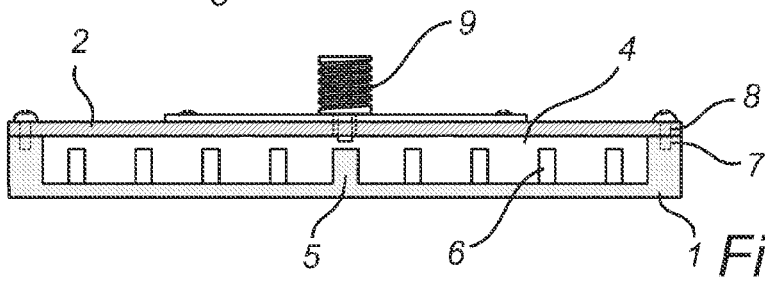
FIG. 2 shows a cross section of the example in FIG. 1 at the position of a probe, when the upper surface is mounted. The figure shows only the geometry in the vicinity of the cross section.

FIG. 2 shows a cross section at the position of the probe 9, which is connected to a coaxial connector at the outside of the surface 8. Thus, the probes provide a connection to the exterior of the gap region, but this can also be done in many different ways. The gap 4 is air-filled, but it can also be fully or partly filled with dielectric material.

Figure 3:
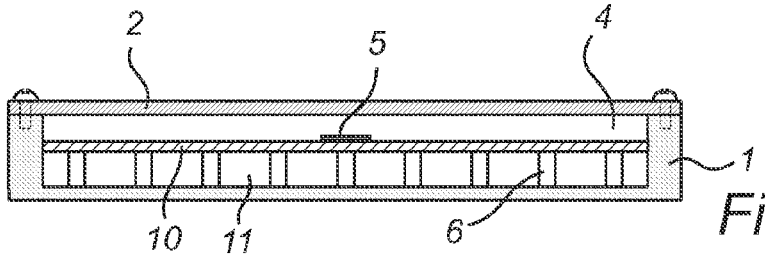
FIG. 3 shows the same cross section of the example at another position and for another embodiment using a microstrip gap line according to the invention. The figure shows only the geometry in the vicinity of the cross section.
Figure 4:
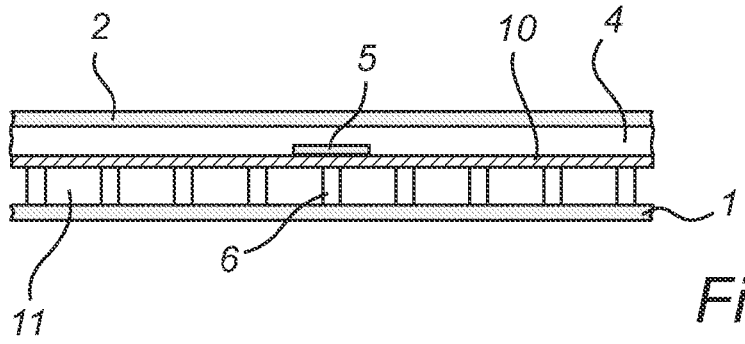
FIGS. 4, 5, 6, 8, 9, 14, 15 and 16 show the cross sections of gap line and waveguides according to the invention. Only the close vicinities of the lines are shown.

FIGS. 3 and 4 show the same power divider example as in FIG. 1, but the metal posts 6 are now used under the entire gap 4. A metal strip 5 forms a microstrip gap line. This is supported by a thin substrate layer 10 located on the top of the posts 6. The space 11 between the posts is air-filled. The metal strip can support waves between itself and the upper metal surface.

Figure 5:
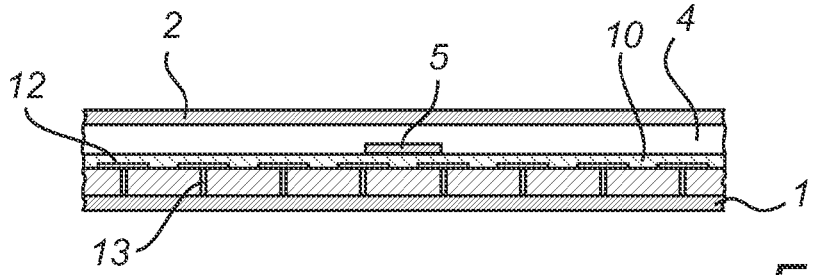
Figure 7:
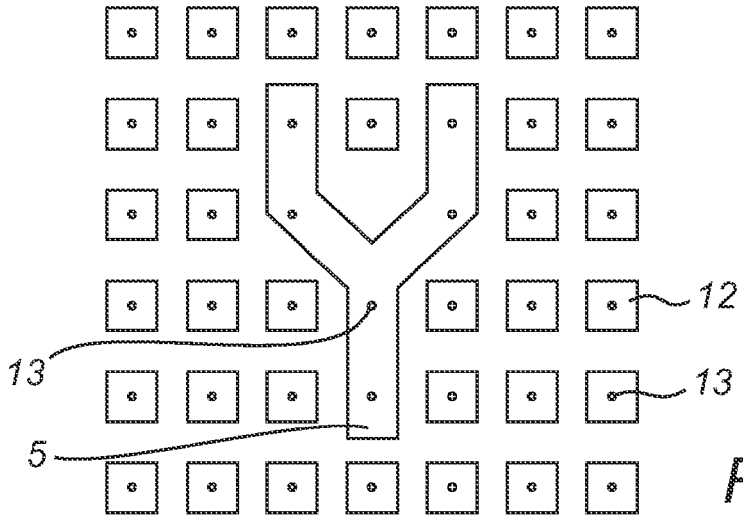
FIGS. 7, 12 and 13 show possible lay-outs of the texture in surfaces according to the invention, corresponding to the example in FIG. 1, but with another realization of the texture.

FIG. 5 shows a similar embodiment of a microstrip gap line as the one in FIGS. 3 and 4, except that the metals posts 6 are replaced by an EBG surface in the form of metal patches 12. These form a periodic pattern in two directions along the lower surface, as shown in FIG. 7, and each patch is provided with a metal connection to the ground plane 1, in the form of metalized via holes 13, also simply called vias. The via holes makes the EBG surface work over a wider bandwidth.

Figure 6:
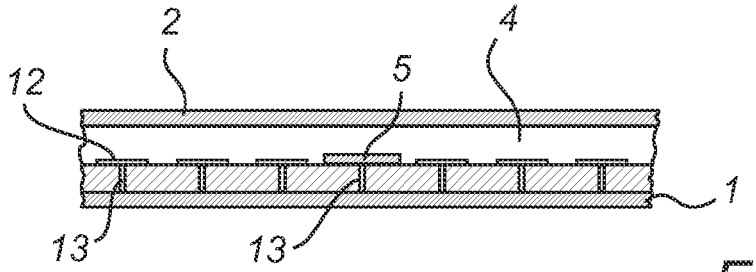

The embodiment in FIGS. 6 and 7 is very similar to the one in FIG. 5, even though FIG. 6 shows a ridge gap waveguide. The microstrip line 5 is shorted with a line of closely located metallised via holes 13 to the ground plane 1, so that it works like a ridge gap waveguide.

Figure 8:
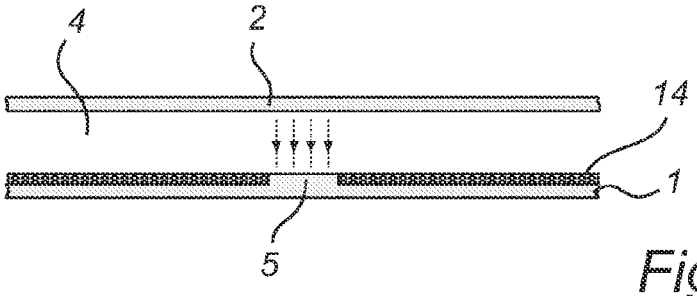
Figure 9:
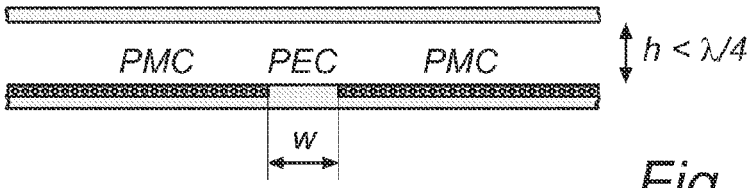

Canonical ridge gap waveguides are shown in FIGS. 8 and 9. In FIG. 8 the ridge 5 is surrounded by a textured surface 14 that stops waves from leaving the ridge guide itself, by providing a cut-off condition for the waves, according to the invention. This surface 14 can e.g. be a realization of an EBG surface or a PMC. The approximate E-field lines between the upper metal surface 2 and the ridge 5 is shown. In FIG. 9 the surface that stops wave propagation is shown as a PMC, and the mathematical wave stop condition is shown.

FIGS. 10 and 11 show how the wave stop surface 14 is located to stop waves approaching the 90 deg bend from continuing to propagate straight forward. The waves are indicated as wave shaped arrows pointing in the propagation direction. The lengths of the arrows indicate the amplitudes of the different waves. The approaching wave may instead either be reflected (undesired) or turn left (desired). The desired turn of the wave can be achieved by properly cutting the corner of the bend as shown. FIG. 11 shows the stop surface 14 in canonical form as a PEC/PMC strip grid. The dark patterned area is a realization of a PMC, and the light area is a PEC. The PEC/PMC strips will very efficiently stop wave propagation in the straight forward direction.

Figure 12:
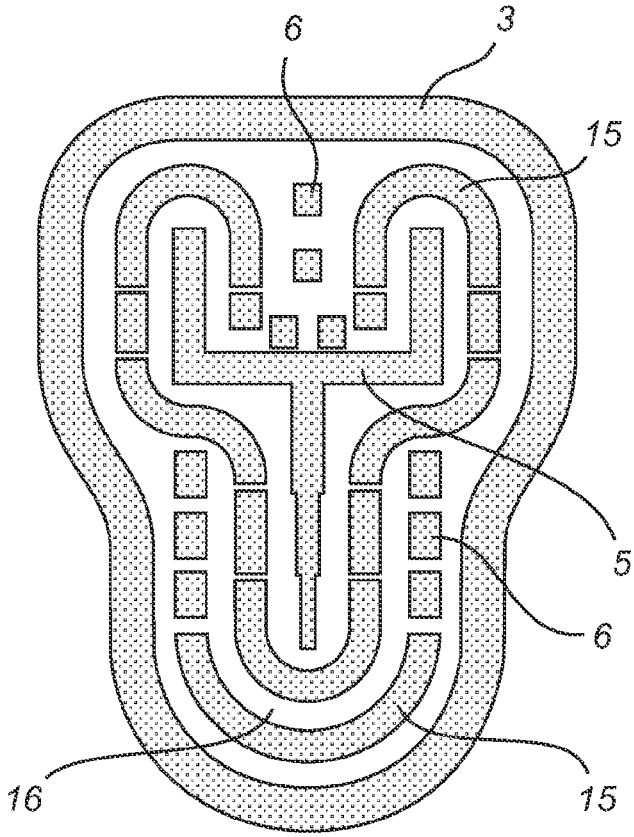

FIG. 12 shows a possible different embodiment of the example in FIG. 1. Here, ridges 15 and grooves 16 are used in addition to posts 6 in order to make sure that waves do not propagate along undesired directions away from the ridges guide itself.

Figure 13:
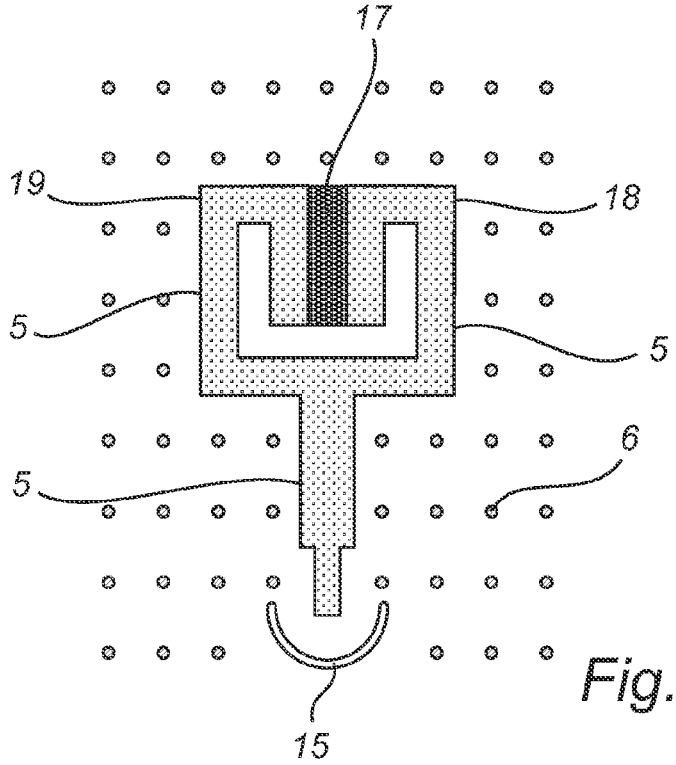

FIG. 13 shows the same example as in FIG. 1, but there is a piece of absorbing material 17 between the two output ports 18 and 19. This makes the example work with isolated outputs, if properly design.

FIGS. 14, 15 and 16 show different groove gap waveguides, but it may also be in the upper surface, or there may be two opposing grooves in both surfaces. The groove 20 is provided in the lower surface. The groove supports a horizontally polarized wave in FIGS. 14 and 15, provided the distance from the top surface to the bottom of the groove is more than typically 0.5 wavelengths in FIG. 14, and 0.25 wavelengths in FIG. 15. The groove in FIG. 16 supports a vertically polarized wave when the width of the groove is larger than 0.5 wavelengths. The widths of the grooves in FIGS. 14 and 15 should preferably be narrower than 0.5 wavelengths, and the distance from the bottom of the groove in FIG. 16 to the upper surface should preferably be smaller than effectively 0.5 wavelengths (may be even smaller depending on gap size), both in order to ensure single-mode propagation. The lower surfaces in FIGS. 14 and 16, and the upper surface in FIG. 15 are provided with a wave stop surface 14. The wave stop surface can have any realization that prevents the wave from leaking out of the groove 20.

The invention is not limited to the embodiments shown here. In particular, the invention can be located inside the package of an IC or in the multiple layers on an IC chip. Also, at least one of the conducting surfaces may be provided with penetrating probes, apertures, slots or similar elements through which waves are radiated or being coupled to exterior circuits.

The invention claimed is:

1. A microwave device, such as a waveguide, transmission line, waveguide circuit or transmission line circuit, comprising two opposing surfaces of conducting material arranged to form a narrow gap there between, wherein at least one of the opposing surfaces is provided with at least one conducting element, said conducting element being a conducting ridge; and wherein at least one of the surfaces is provided with means that stops wave propagation in other directions inside the gap than along said conducting ridge(s), at least at a frequency of operation, and wherein the two surfaces are connected together for rigidity by a mechanical structure defining an end of the gap at some distance outside a region with guided waves.

2. The microwave device according to claim 1, wherein the device forms a waveguide circuit comprising several waveguide components realized between the two opposing surfaces.

3. The microwave device according to claim 1, wherein the two opposing surfaces and the mechanical structure provide a complete encapsulation of the conducting element and the means for stopping wave propagation.

4. The microwave device according to claim 1, wherein the at least one conducting element is arranged to guide a single-mode wave inside the gap.

5. A waveguide or waveguide circuit, according to claim 1, wherein at least part of one of the surfaces are provided with a texture that is designed in such a way that it stops wave propagation inside the gap in other than the desired directions defined by the conducting ridge(s), at least at a frequency of operation.

6. The microwave device according to claim 1, wherein one of the conducting surfaces is smooth.

7. The microwave device according to claim 1, wherein the gap is at least partly filled with dielectric material.

8. The microwave device according to claim 1, wherein the gap is filled with air, gas or vacuum.

9. The microwave device according to claim 1, wherein the mechanical structure is part of at least one of the conducting materials defining one of the opposing surfaces.

10. The microwave device according to claim 1, wherein at least part of the two opposing surfaces are mostly planar except for a fine structure provided by the conducting ridge(s).

11. The microwave device according to claim 1, wherein at least part of the two surfaces are curved in the same way so that the gap between them keeps is so small that wave propagation in undesirable directions inside the gap is stopped, and so that if they are strongly curved the opposing surfaces may reduce in the limit to a thin wire, sharp edge or wedge.

12. The microwave device according to claim 1, wherein at least part of at least one of the opposing surfaces is provided with closely located posts of conducting material rising from an otherwise smooth conducting surface.

13. The microwave device according to claim 1, wherein at least part of at least one of the opposing surfaces is provided with one or more grooves, ridges or corrugations that are designed to stop wave propagation very strongly in certain directions, at least at a frequency of operation.

14. The microwave device according to claim 1, wherein at least part of one layer is a complete metal layer except for possible small apertures working as antennas or providing a hole for connecting an interior gap waveguide circuits to circuits outside the two opposing material surfaces.

15. The microwave device according to claim 1, wherein the means for stopping wave propagation comprises metal elements in a multilayer structure, forming a realization of an electromagnetic bandgap surface, at least at a frequency of operation.

16. The microwave device according to claim 1, wherein the means for stopping wave propagation comprises metal elements in a multilayer structure, forming a high impedance surface, also called artificial magnetic conductor, being an attempted realization of a perfect magnetic conductor, at least at a frequency of operation.

17. The microwave device according to claim 1, wherein the means for stopping wave propagation comprises metal elements that stop wave propagation, forming a strip grid where every second strip is a perfect electric conductor and a realization of a perfect magnetic conductor, respectively, stopping wave propagation very strongly in directions orthogonal to the strips, at least at a frequency of operation.

18. The microwave device according to claim 1, wherein the gap region contains integrated circuits.

19. The microwave device according to claim 1, wherein the two opposing surfaces and the gap between them are located inside an IC package.

20. The microwave device according to claim 1, wherein the two opposing surfaces and the gap between them are located in a multilayer structure on an IC chip.

21. A microwave device or part of such device, such as a waveguide, transmission line, waveguide circuit or transmission line circuit, comprising two opposing surfaces of conducting material arranged to form a narrow gap there between, wherein at least one of the surfaces is provided with at least one conducting element, said conducting element being a groove with conducting walls; and wherein at least one of the opposing surfaces is provided with means that stops wave propagation in other directions inside the gap than along said groove(s), at least at a frequency of operation, and wherein the two surfaces are connected together for rigidity by a mechanical structure defining an end of the gap at some distance outside a region with guided waves.

22. The microwave device of claim 21, wherein the conducting walls of the grooves have no metal contact with the opposing surface.

23. The microwave device according to claim 21, wherein the at least one conducting element is arranged to guide a single-mode wave.

24. The microwave device according to claim 21, wherein at least part of one of the two opposing surfaces is provided with a multilayer structure that contains conductive elements that are arranged in such a way that they stop wave propagation in other directions inside the gap than those defined by the grooves, at least at a frequency of operation.

25. A waveguide or waveguide circuit, according to claim 21, wherein at least part of one of the surfaces are provided with a texture that is designed in such a way that it stops wave propagation inside the gap in other than the desired directions defined by the grooves, at least at the frequency of operation.

26. The microwave device according to claim 21, wherein one of the conducting surfaces is smooth.

27. The microwave device according to claim 21, wherein the gap is at least partly filled with dielectric material.

28. The microwave device according to claim 21, wherein the gap is filled with air, gas or vacuum.

29. The microwave device according to claim 21, wherein the mechanical structure is part of at least one of the conducting materials defining one of the opposing surfaces.

30. The microwave device according to claim 21, wherein at least part of the two surfaces are mostly planar except for a fine structure provided by ridges, second grooves and texture.

31. The microwave device according to claim 21, wherein at least part of the two surfaces are curved in the same way so that the gap between them is so small that wave propagation in undesirable directions inside the gap is stopped, and so that if they are strongly curved the opposing surfaces may reduce in a limit to a thin wire, sharp edge or wedge.

32. The microwave device according to claim 21, wherein at least part of at least one of the opposing surfaces is provided with closely located posts of conducting material rising from the otherwise smooth conducting surface(s).

33. The microwave device according to claim 21, wherein at least part of at least one of the surfaces is provided with one or more ridges corrugations or second grooves, that are designed to stop wave propagation very strongly in certain directions, at least at a frequency of operation.

34. The microwave device according to claim 21, wherein at least part of one layer is a complete metal layer except for possible small apertures working as antennas or providing a hole for connecting interior gap waveguide circuits to circuits outside the two opposing material surfaces.

35. The microwave device according to claim 21, wherein the means for stopping wave propagation comprises metal elements in a multilayer structure, forming a realization of an electromagnetic bandgap surface, at least at a frequency of operation.

36. The microwave device according to claim 21, wherein the means for stopping wave propagation comprises metal elements in a multilayer structure, forming a high impedance surface, also called artificial magnetic conductor, being an attempted realization of a perfect magnetic conductor, at least at a frequency of operation.

37. The microwave device according to claim 21, wherein the means for stopping wave propagation comprises metal elements, forming a strip grid where every second strip is a perfect electric conductor and a realization of a perfect magnetic conductor, respectively, stopping wave propagation very strongly in directions orthogonal to the strips, at least at a frequency of operation.

38. The microwave device according to claim 21, wherein the gap region contains integrated circuits.

39. The microwave device according to claim 21, wherein the two opposing surfaces and the gap between them are located inside an IC package.

40. The microwave device according to claim 21, wherein the two opposing surfaces and the gap between them are located in a multilayer structure on an IC chip.

41. A microwave device or part of such device, such as a waveguide, transmission line, waveguide circuit or transmission line circuit, comprising two opposing surfaces of conducting material arranged to form a narrow gap there between, wherein at least one of the surfaces is provided with at least one conducting element, said at least one conducting element being a conducting strip; and wherein at least one of the opposing surfaces is provided with means that stops wave propagation in other directions inside the gap than along said conducting strip(s), at least at a frequency of operation, and wherein at least one of the two opposing surfaces comprises small apertures working as antennas or providing a hole for connecting interior gap waveguide circuits to circuits outside the two opposing surfaces.

42. The microwave device according to claim 41, wherein the microwave device forms a transmission line or a transmission line circuit, and wherein at least one of the surfaces is provided with a multilayer structure and the at least one conducting element comprises at least one conducting strip arranged on said multilayer structure, along each of which a single-mode wave is guided inside the gap.

43. A waveguide or waveguide circuit, according to claim 41, wherein at least part of one of the surfaces are provided with a texture that is designed in such a way that it stops wave propagation inside the gap in other than the desired directions defined by the strips claims, at least at a frequency of operation.

44. The microwave device according to claim 41, wherein one of the conducting surfaces is smooth.

45. The microwave device according to claim 41, wherein the gap is at least partly filled with dielectric material.

46. The microwave device according to claim 41, wherein the gap is filled with air, gas or vacuum.

47. The microwave device according to claim 41, wherein the two surfaces are connected together for rigidity by a mechanical structure defining an end of the gap at some distance outside a region with guided waves, where the mechanical structure may be part of at least one of the conducting materials defining one of the opposing surfaces.

48. The microwave device according to claim 41, wherein at least part of the two surfaces are mostly planar.

49. The microwave device according to claim 41, wherein at least part of the two surfaces are curved in the same way so that the gap between them keeps is so small that wave propagation in undesirable directions inside the gap is stopped, and so that if they are strongly curved the inner surface may reduce in the limit to a thin wire, sharp edge or wedge.

50. The microwave device according to claim 41, wherein at least part of at least one of the surfaces is provided with closely located posts of conducting material rising from at least one of the opposing surface(s).

51. The microwave device according to claim 41, wherein at least part of at least one of the surfaces is provided with one or more grooves, ridges or corrugations that are designed to stop wave propagation very strongly in certain directions, at least at a frequency of operation.

52. The microwave device according to claim 41, wherein at least some of the conductive elements of the multilayer structure are metal patches or metal strips.

53. The microwave device according to claim 41, wherein there are metalized via holes between two or more of the layers in the multilayer structure.

54. The microwave device according to claim 41, wherein the means for stopping wave propagation comprises metal elements in a multilayer structure, forming a realization of an electromagnetic bandgap surface, at least at a frequency of operation.

55. The microwave device according to claim 41, wherein the means for stopping wave propagation comprises metal elements in a multilayer structure, forming a high impedance surface, also called artificial magnetic conductor, being an attempted realization of a perfect magnetic conductor, at least at a frequency of operation.

56. The microwave device according to claim 41, wherein the means for stopping wave propagation comprises metal elements forming a strip grid where every second strip is a perfect electric conductor and a realization of a perfect magnetic conductor, respectively, stopping wave propagation very strongly in directions orthogonal to the strips, at least at a frequency of operation.

57. The microwave device according to claim 41, wherein the gap region contains integrated circuits.

58. The microwave device according to claim 41, wherein the two opposing surfaces and the gap between them are located inside an IC package.

59. The microwave device according to claim 41, wherein the two opposing surfaces and the gap between them are located in a multilayer structure on an IC chip.

60. A microwave device or part of such device, such as a waveguide, transmission line, waveguide circuit or transmission line circuit, comprising two opposing surfaces of conducting material arranged to form a narrow gap there between, and a thin substrate layer being arranged between said two opposing surfaces, and being provided with at least one conducting element, said at least one conducting element being a conducting strip; and wherein at least one of the two opposing surfaces is provided with means that stops wave propagation in other directions inside the gap than along said conducting element, at least at a frequency of operation, said thin substrate being arranged on top of said means that stops wave propagation, and the conducting strip being arranged on the opposite side of the thin substrate layer.

61. The microwave device of claim 60, wherein the means that stops wave propagation inside the gap comprises closely located posts of conducting material rising from an otherwise smooth conducting surface.

62. The microwave device of claim 60, wherein the means that stops wave propagation inside the gap comprises an electromagnetic bandgap surface.

63. The microwave device of claim 60, wherein the means that stops wave propagation inside the gap extends over the entire gap.

64. A microwave device or part of such device, such as a waveguide, transmission line, waveguide circuit or transmission line circuit, comprising two opposing surfaces of conducting material arranged to form a narrow gap there between, wherein at least one of the surfaces is provided with at least one conducting element, said at least one conducting element being at least one of: a conducting ridge, a groove with conducting walls, and a conducting strip; and wherein a plurality of metalized via holes are arranged through a layer on top of at least one of said opposing surfaces, the metalized via holes being in metal connection with said surface, whereby said metalized via holes stop wave propagation in other directions inside the gap than along said conducting element(s), at least at the frequency of operation.

65. The microwave device of claim 64, wherein the metalized via holes are further connected to metal patches.

66. The microwave device of claim 64, wherein the conducting element(s) is a conducting ridge, said ridge being realized by a conducting strip being connected to one of said opposing surface via some of said metalized via holes.

67. The microwave device of claim 64, wherein the conducting element(s) is a conducting strip, said conducting strip are provided on a thin substrate layer being arranged between said two opposing surfaces and on the top of said metalized via holes.

* * * * *